United States Patent [19]

Lohmer et al.

[11] 4,018,609

[45] Apr. 19, 1977

[54] COLOR PHOTOGRAPHIC MULTILAYERED MATERIAL WITH LAYERS OF ACID ASHED GELATINE

[75] Inventors: Karl Lohmer, Leverkusen; Hermann Seiz, Heilbronn; Karl Zietan, Cologne, all of Germany

[73] Assignee: AGFA-Gevaert, A.G., Leverkusen, Germany

[22] Filed: May 27, 1975

[21] Appl. No.: 580,905

[30] Foreign Application Priority Data

June 8, 1974 Germany ..... 2427700

[52] U.S. Cl. ..... 96/74; 96/50 PL; 96/114.7

[51] Int. Cl.[2] ..... G03C 3/00; G03C 5/26; G03C 1/02

[58] Field of Search ..... 96/114.7, 74, 50 PL

[56] References Cited

UNITED STATES PATENTS 3,551,151 12/1970 Malan ..... 96/114.7

FOREIGN PATENTS OR APPLICATIONS 68,850 10/1973 Poland ..... 96/114.7

*Primary Examiner*—David Klein
*Assistant Examiner*—Lovix Falasco
*Attorney, Agent, or Firm*—Connolly and Hutz

[57] ABSTRACT

In a color photographic multilayered material which is suitable for rapid processing the protective layer and the auxiliary layers contain pigskin gelatine ashed under acid condition.

3 Claims, No Drawings

COLOR PHOTOGRAPHIC MULTILAYERED MATERIAL WITH LAYERS OF ACID ASHED GELATINE

This invention relates to a colour photographic multilayered material which is suitable for rapid processing.

It is known to use bone or skin gelatine as binder for preparing the individual emulsion and auxiliary layers in the layer combination of a multilayered photographic material. These gelatines are generally prepared by alkaline ashing and then cast together with hardeners, wetting agents and the like. These types of gelatine are generally satisfactory if sufficient time is available for the application and drying of the layers so that the gel state can develop during drying. By gel state is meant a state in which the gelatine molecules are highly organised by partial crystallite formation. Layers prepared in this way are very similar to each other in their swelling properties and, after they have been cross-linked with added hardener, they can be processed completely satisfactorily even at elevated temperatures.

However, the long drying times of 10 to 60 minutes required at casting temperatures below 25° C render the preparation of a photographic multilayered material uneconomic since it is necessary either to carry out the coating process very slowly or to use extremely long drying passages. If in the processes previously employed, the cast gelatine layers are not given the time indicated above for developing the molecular state of organisation, then differences appear between the individual layers when the gelatine subsequently undergoes cross-linking (hardening), and these differences result in differing swelling properties when the layers are subsequently processed in the photographic baths. These differences in the swelling properties of the individual layers have the effect that the layer which undergoes greater swelling becomes compressed and warped. The surface of such photographic material is no longer even but is wrinkled and does not have the required gloss.

It is an object of this invention to provide a photographic multilayered material which will be free from wrinkles on the surface even when rapidly dried. It has now been found that this problem can be reduced or substantially obviated by means of a colour photographic multilayered material which contains pigskin gelatine ashed under acid condition as binder in the protective layer and in the auxiliary layers situated between the light-sensitive silver halide layers.

This invention therefore relates to a light-sensitive colour photographic material comprising a red sensitive silver halide gelatine emulsion layer which contains a cyan coupler, a green sensitive silver halide emulsion layer which contains a magenta coupler and a blue sensitive silver halide gelatine emulsion layer which contains a yellow coupler as well as intermediate layers and a protective layer applied on the outside, in which the binders for the intermediate layers and the protective layer consist substantially of acid ashed pigskin gelatine.

It has been found particularly suitable to use an inert, acid ashed pigskin gelatine which has been rendered inert by oxidation or desalted by ion exchangers to eliminate any impurities which might have a photographically harmful effect. The isoelectric point should be between 6.5 and 9.5. The viscosity $\nu$ of the 10% aqueous solution should be between 15 and 35 cP. The solidity of the gel should be above 170 Bloom.

To determine the solidity of the gel by Bloom's method, a 6.66% aqueous gelatine solution is first cooled in a so-called Bloom glass at 10° C for 16 hours. To measure the solidity, a cylindrical punch 12.7 mm in diameter is forced into the gel to a depth of 4 mm. The weight in gram required to push the punch in to that depth is given as the Bloom value.

Gelatine which has been decomposed by acid differs from the alkaline decomposed gelatine which is generally used for photographic materials by its isoelectric point (IEP) which, in the case of alkaline decomposed gelatines, is generally in the region of pH 4.8 to 5.2 since the basic amide groups are for the most part hydrolysed. The isoelectric point of acid decomposed gelatines is generally in the region of pH 6.5 to 9.5. The isoelectric point indicates the charge of a protein. It is defined as the pH of a buffer solution at which no migration of the protein takes place when an electric field is applied.

Details about the properties of acid decomposed gelatines and the acid decomposition process may be found in the chapter entitled "Acid Precursor Gelatines, Structure and Significance in the Collagen-Gelatine Transition Process" by A. Veis, J. Anesey and J. Cohen from "Recent Advances in Gelatine and Glue Research", Pergamon Press, pages 155–163, London, 1958 as well as Japanese Patent Specification No. 23 186/63 and the article by G. Reich in Ges. Abh.Dtsch. Lederind. Freiberg/Sa. 1962, No. 18, page 15.

To remove any photographically harmful impurities present, the acid decomposed pigskin gelatine is rendered inert by oxidation or desalted with ion exchangers as has been described above.

A pigskin gelatine suitable for the colour photographic materials according to the invention may therefore be prepared as follows:

The skins are first washed for 10 to 15 hours and softened in 2% hydrochloric acid at 30° C for 2 days. They are then again washed for 10 to 15 hours and finally extracted at pH 5.5 and 60° to 95° C.

To purify the gelatine, the solution is then carefully freed from fat impurities by filtration and subsequently completely desalted by an ion exchanger. The gelatine can be rendered more completely inert if, instead of being desalted, it is subjected to an oxidative treatment with 100 l. of hydrogen peroxide (4%) per 5 $m^3$ of 25% gelatine solution for 30 minutes at 55° C immediately before drying. In this case, the excess hydrogen peroxide must be removed by the addition of an aqueous sulphur dioxide solution.

Colour photographic multilayered materials in which, according to the invention, the silver halide emulsion layers which contain colour component contain the conventional binders consisting of alkaline ashed gelatines but the binders used for the intermediate and protective layers are acid ashed pigskin gelatines, can be dried within surprisingly short times of between half a minute and 5 minutes without forming wrinkled or matt surfaces.

No differences between the cross-linking of the various layers by the action of the added hardeners therefore occurs in the photographic multilayered material according to the invention when shorter drying times are employed and consequently there are no differences between their swelling values which would result in reticulation and a matt surface when the layers are subsequently processed. The rate of drying in the production of photographic multilayered materials containing colour components can therefore be substantially increased and much higher casting rates or shorter drying passages can be employed without any loss of quality. Reticulation or a matt gloss after processing in the photographic baths does not occur in the layer compositions according to the invention even if the bath temperature is increased and development is carried out, for example, at 30° to 50° C.

In accordance with the present invention, light-sensitive colour photographic materials include the known types of photographic colour materials, i.e. negative, positive or reversal materials. The colour photographic multilayered materials comprise, as is usual, at least one blue-sensitive silver halide emulsion layer containing a yellow coupler, at least one green sensitized silver halide emulsion layer containing a magneta coupler and at least one red-sensitised silver halide emulsion layer containing a cyan coupler, and in addition one or more intermediate layers, filter layers and surface protection layers.

The couplers in the colour photographic material according to the invention may be any of the known compounds used for this purpose, phenols or naphthols may be used as couplers for the formation of cyan dyes, pyrazolones or indazolones as couplers for the formation of magenta dyes and compounds which contain a methylene group with two carbonyl groups may be used as couplers for the formation of the yellow dye. It is immaterial whether the couplers used are so-called emulsification couplers, i.e. hydrophobic couplers, or whether they contain one or more water-solubilizing groups. The dyes formed by coupling are azomethines, indamines or indophenols, depending on the composition of the coupler and the developer.

The light-sensitive emulsion layers of the colour photographic material according to the invention may also contain the usual silver halides such as silver chloride, silver bromide or mixtures thereof, which may have a small silver iodide content of up to 10 mols percent, dispersed in gelatine normally used for this purpose.

The emulsion layers or auxiliary layers may also contain the known additives conventionally used for colour photographic materials, such as chemical sensitizers, development accelerators, stabilizers, hardeners, antistatic agents, plasticizers, coating agent, matting agents, brightening agents and screening or sharpening dyes, in other words the kind of additives conventionally used for photographic silver halide materials, e.g. those summarized and described in the Journal "Product Licensing Index", Vol. 92, December 1971, pages 107 to 109.

EXAMPLE 1

The following layers were applied to a substrate corona irradiated polyethylene backed paper:

1. A silver chlorobromide gelatine emulsion which had been sensitized to red light and contained a cyan coupler and which contained per kg of casting solution 0.1 mol of silver halide, 8 g of coupler and 54 g of gelatine as well as 1 g of saponin and 0.5 g of triacryloformal was cast to form a layer containing 40 g/m² when wet.

The wet layer was then exposed to an intense blast of air containing 2 g of water per kg at 25° C so that in the first drying phase the layer was dried at the rate of 35 g of water per m² and minute. Under these conditions, the layer was dry after about 1.5 minutes.

2. A 6% aqueous gelatine solution (prepared with alkaline ashed bone gelatine) which contained 0.5 g of saponin and 0.3 g of triacryloformal per liter of casting solution was cast on this emulsion layer to form a coating weighing 30 g/m³ when wet.

The fresh layer was dried in the same way as the previously applied emulsion layer and drying was completed after 1.2 minutes.

3. A silver chlorobromide gelatine emulsion which had been sensitized to green light and contained magenta coupler was then applied in the quantities indicated under (1.) and dried as described there.
4. The next layer cast was similar to that described under (2.).
5. A silver bromide emulsion which contained yellow coupler and was sensitive to blue light was then applied. The same proportions were employed as under (1.) and drying was also carried out in a similar manner.
6. A gelatine layer similar to that described under (2.) was then applied.

EXAMPLE 2

A photographic multilayered material similar to that of Example 1 was prepared. In this material, the substrate and the casting solutions for layers (1), (3) and (5) were the same as those used in Example 1 but the gelatine used for casting solutions (2), (4) and (6) was in this case replaced by an acid ashed pigskin gelatine which had an isoelectric point of 8.0, a gel solidity of 200 Bloom and a viscosity of 17 cP in 10% aqueous solution.

The other components and drying conditions were the same.

EXAMPLE 3

Another multilayered material was cast from casting solutions (1) to (6) of Example 1 but in this case the layers were dried with air which was at a temperature of 18° C and contained 8 g of water per kg so that the drying time was approximately 10 to 12 minutes per layer.

The materials prepared according to Examples 1 to 3 were first stored at room temperature for one week so that the cross-linking of gelatine by the triacrylformal added to the casting solution could take place.

A sample of each of the photographic multilayered materials prepared according to Examples 1, 2 and 3 was then exposed behind a step wedge with a step factor of 0.15 and subjected to colour development (German Offenlegungsschrift No. 1,328,554). The temperature of the baths was adjusted to 24° C.

When the samples had been processed, they were dried in air.

The following results were obtained.

The comparison sample prepared according to Example 1 had a matt surface whereas samples of the materials prepared according to Examples 2 and 3 of the invention had a satisfactory surface gloss. After the multilayered materials prepared according to Examples 1, 2 and 3 had been stored for a further 4 weeks at room temperature, processing of the three samples was repeated but the temperature of the baths was raised to 35° C to shorten the processing time.

After drying, it was again found that the sample of material prepared according to Example 1 had no gloss but a matt surface whereas samples of multilayered materials prepared according to Examples 2 and 3 had a satisfactory surface gloss.

Microscopic examination of the samples showed that layers of the sample from Example 1 undergo irregular compression and warping when processed due to differences between the swelling values of the different layers, with the result that a wrinkled, matt surface was obtained. Samples from Examples 2 and 3, on the other hand, showed no signs of compression or warping and therefore had a smooth, glossy surface.

We claim:

1. The light sensitive multi-layer photographic material having in combination sensitized layers comprising a red sensitive silver halide gelatine emulsion layer which contains alkaline-treated gelatine and a cyan coupler, a green sensitive silver halide gelatine emulsion layer which contains alkaline-treated gelatine and a magenta coupler and a blue sensitive silver halide gelatine emulsion layer containing alkaline-treated gelatine and a yellow coupler, and at least one intermediate light insensitive layer positioned between said sensitized layers and containing a gelatine binder, and protective covering layer overlying said sensitized layers containing a gelatine binder, wherein the improvement comprises the gelatine binder of said intermediate and protective covering layer consists essentially of inert acid-ashed gelatine having an isoelectric point of between 6.5 and 9.5.

2. Light-sensitive colour photographic material according to claim 1, characterised in that it contains an acid ashed gelatine which has been purified either by oxidation to render it inert or by desalting.

3. The light sensitive multi-layer photographic material as claimed in claim 1 wherein the acid-ashed gelatine has a viscosity in 10% aqueous solution of between 15 and 35 cp and a gel solidity above 170 Bloom.

* * * * *